US007207497B2

(12) United States Patent
Clark

(10) Patent No.: US 7,207,497 B2
(45) Date of Patent: Apr. 24, 2007

(54) DRY FLAKE SPRAYER AND METHOD

(76) Inventor: Rikk A. Clark, 473 Cancun Ct., Fallbrook, CA (US) 92028

( * ) Notice: Subject to any disclaimer, the term of this patent is extended or adjusted under 35 U.S.C. 154(b) by 307 days.

(21) Appl. No.: 10/372,378

(22) Filed: Feb. 22, 2003

(65) Prior Publication Data

US 2004/0195367 A1 Oct. 7, 2004

(51) Int. Cl.
*B05B 17/00* (2006.01)

(52) U.S. Cl. ..... 239/1; 239/302; 239/316; 239/335; 239/342; 239/346; 239/361; 427/136; 427/137; 427/197; 427/202

(58) Field of Classification Search ..... 239/318, 239/346, 434, 302, 347, 654, 335, 316, 342, 239/361, 296, 298; 427/202–205
See application file for complete search history.

(56) References Cited

U.S. PATENT DOCUMENTS

| | | | | |
|---|---|---|---|---|
| 1,191,751 | A | 7/1916 | Walkup | |
| 1,632,515 | A | 6/1927 | Smith | |
| 1,976,799 | A | 10/1934 | Nelson | |
| 2,003,087 | A | 5/1935 | Lynger | |
| 2,029,408 | A * | 2/1936 | Bramsen et al. | 239/654 |
| 2,235,278 | A * | 3/1941 | Brunner | 422/264 |
| 2,293,390 | A | 8/1942 | Hengesbach | |
| 2,792,151 | A * | 5/1957 | Wagner | 239/654 |
| 3,191,869 | A | 6/1965 | Gilmour | |
| 3,542,250 | A | 11/1970 | McRitchie | |
| 3,770,205 | A | 11/1973 | Proctor | |
| 3,785,568 | A | 1/1974 | Pfingsten | |
| 3,819,119 | A | 6/1974 | Coffey | |
| 4,123,005 | A | 10/1978 | Blunk | |
| D289,675 | S | 5/1987 | Beal | |
| 4,809,913 | A | 3/1989 | Gunlock | |
| 4,856,931 | A * | 8/1989 | Bollag | 404/75 |
| 4,936,511 | A | 6/1990 | Johnson | |
| 4,971,251 | A | 11/1990 | Dobrick | |
| 4,987,001 | A * | 1/1991 | Knobbe et al. | 427/478 |
| 5,039,017 | A | 8/1991 | Howe | |
| 5,183,206 | A | 2/1993 | Gavin | |
| 5,236,106 | A | 8/1993 | Laska | |
| D349,558 | S | 8/1994 | Albers | |
| 5,372,310 | A | 12/1994 | Ketcham | |
| 5,620,138 | A * | 4/1997 | Crum | 239/3 |
| 5,620,750 | A | 4/1997 | Minoura | |
| 5,647,535 | A | 7/1997 | Nakazono | |
| 5,674,560 | A * | 10/1997 | Tanigami et al. | 427/202 |

(Continued)

*Primary Examiner*—Dinh Q. Nguyen
(74) *Attorney, Agent, or Firm*—Calif Tervo; Palomar Patent

(57) ABSTRACT

A device 10 for spraying dry flakes 12 including: an enclosure 22 including a lower portion 26 for holding a supply 12A of dry flakes 12 and an upper portion 27; a gas flow conduit 50 including: a receiving portion 52 adapted for connection to a pressurized gas source, and a nozzle 60; a flake conduit 40 connecting enclosure 22 with nozzle 60; and air holes 36 in enclosure 22. Flake conduit 40 includes a valve 44. A flow valve 76, operable by the user, regulates the flow of pressurized gas from a pressurized gas source through gas flow conduit 50. Receiving portion 52 includes pressure regulating valve 77 for regulating the pressure of gas from the pressurized gas source at a given gas flow rate and a pressure indicator 78 for indicating pressure of gas flowing through receiving portion 50.

31 Claims, 1 Drawing Sheet

U.S. PATENT DOCUMENTS 5,699,743 A * 12/1997 Ganz et al. ..... 101/488
5,897,914 A * 4/1999 DePriest ..... 427/137
6,042,026 A 3/2000 Buehler
6,338,440 B1 1/2002 Hörner
6,394,595 B1 * 5/2002 Jiang et al. ..... 347/101

* cited by examiner

FIG. 1
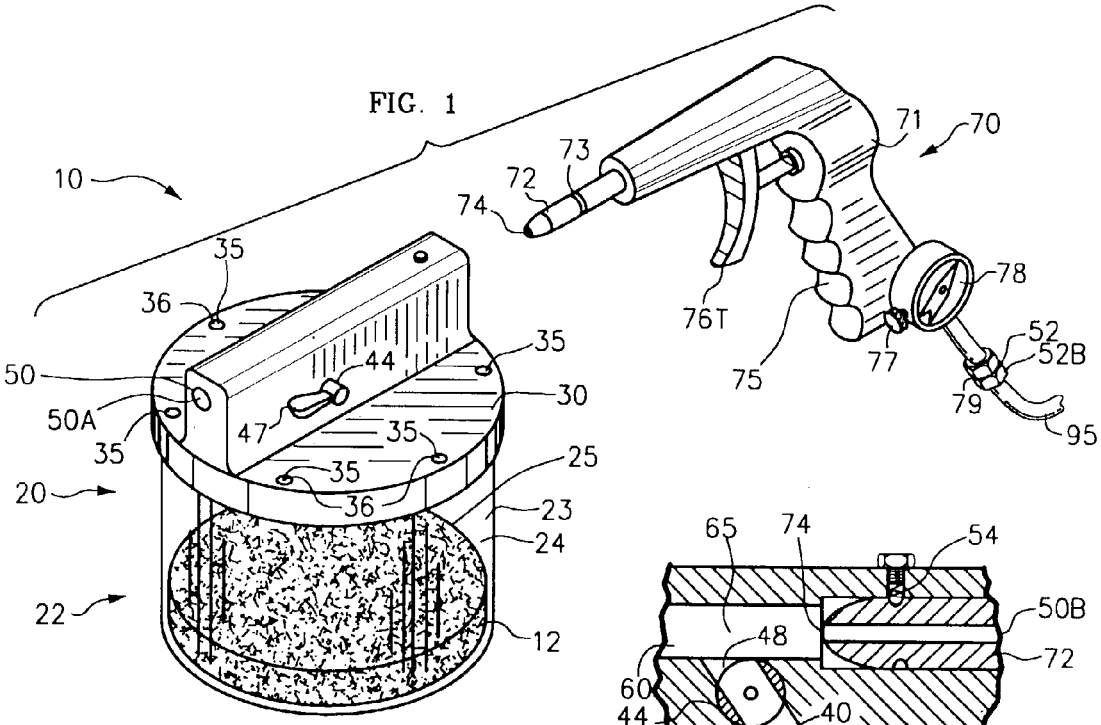
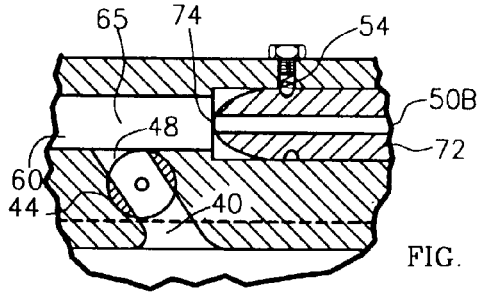
FIG. 3
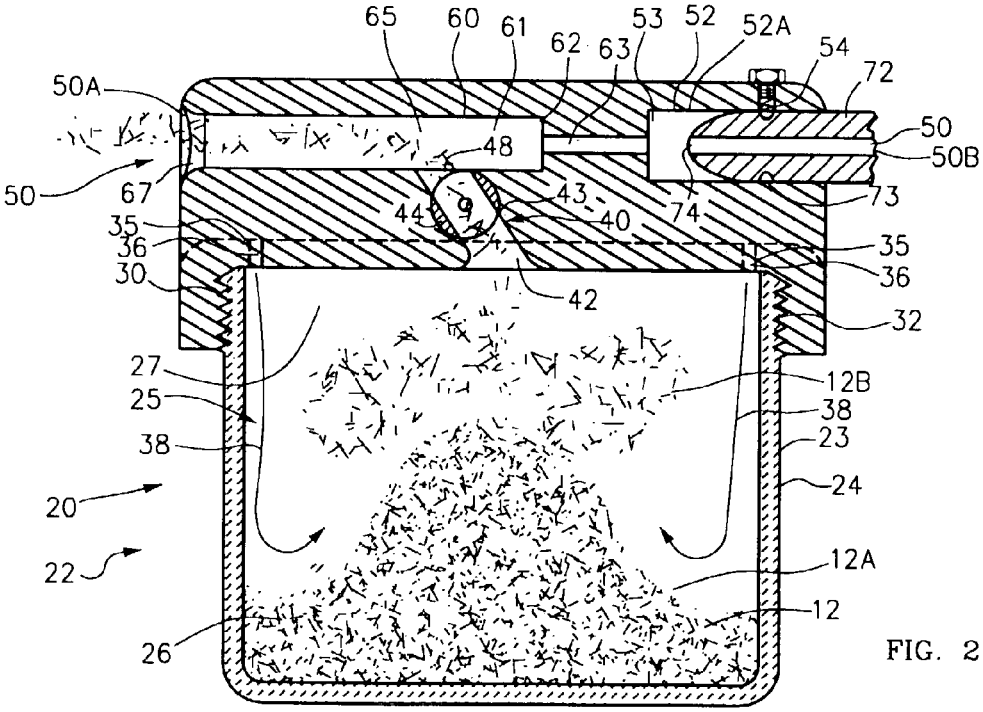
FIG. 2

DRY FLAKE SPRAYER AND METHOD

FIELD OF THE INVENTION

This invention relates in general to painting objects and more specifically to a device and method for applying a reflective glitter or metal-flake paint.

BACKGROUND OF THE INVENTION

Metal-flake/glitter painting produces a glittery and attractive appearance. The reflective flakes in the paint are generally comprised of polyester, although aluminum or other materials can be used.

Conventionally, flake paint is applied to an object by mixing flakes with the clear and/or transparent color paint and spaying the mixture out of an automotive paint spray gun.

There are a number of disadvantages in the prior art.

First, it is difficult to evenly distribute the flakes in the paint. If too many flakes are sprayed, the area of dense flakes must be removed. This usually means cleaning off the entire object and starting over. Conversely, if too few flakes are sprayed, the area of too few flakes must be given additional coats, which results in an uneven surface and too much build up of clear/color coat, often leading to runs in the coat. The paint and flake mixture must be constantly stirred or the flakes will separate from the paint, but there is no good way to constantly stir the mixture.

Second, large flakes cannot be sprayed with paint in conventional paint guns because the spray orifice small to atomize the spray. Flakes are available in sizes of 0.002" to 0.250", but paint guns generally can only spray flakes up to 0.025."

Third, larger flakes may land on edge and not lie flat. A flake on its side will stick out of the paint or, if sanded off, produces a sliver of undesired appearance.

Fourth, if the paint/flake mixture runs out, a new mixture must be mixed in the same proportions for compatibility. This is often difficult.

Fifth, if not all of the mixture is used, it is thrown away, which is a waste of material and generates hazardous material.

Accordingly, there has been a need for a device and method that overcomes the deficiencies of the prior art.

BRIEF DESCRIPTION OF THE DRAWINGS

FIG. 1 is an exploded perspective view of an embodiment of the dry flake spraying device of the invention.

FIG. 2 is an enlarged cross sectional view of the spray module of FIG. 1.

FIG. 3 is a partial cross sectional view of an alternate embodiment of the spray module.

DETAILED DESCRIPTION OF THE INVENTION

With reference now to FIGS. 1 and 2 the drawings, FIG. 1 is an exploded perspective view of an embodiment of the dry flake spraying device 10 of the invention including a spray module 20 and a gun module 70, and FIG. 2 is an enlarged cross sectional view of spray module 20 of FIG. 1.

Spray module 20 generally includes an enclosure 22, a gas flow conduit 50, and a flake conduit 40. Enclosure 22 includes a container 23 and a lid 30. Container 23, such as cylindrical plastic jar 24, has an interior space 25 including a lower portion 26 for holding a supply 12A of dry flakes 12 and an upper portion 27. Preferably, container 23 is sufficiently transparent to observe supply 12A of dry flakes 12. Lid 30 encloses the top of container 23 and may be attached to container 23 by any suitable means, such as cooperating threads 32. In the exemplary embodiment, lid 30 includes ambient gas inlet means 35, such as a plurality of air holes 36, for conducting ambient gas into enclosure 22.

Gas flow conduit 50, in its smallest sense, comprises the gas flow conduit 50A as shown and described with respect to FIG. 2 and FIG. 3. Gas flow conduit 50, in its largest sense, further includes gas flow conduit 50B through gun module 70 and the functional elements acting therewith. Gas flow conduit 50 includes a receiving portion 52 adapted for receiving gas from a pressurized gas source and a nozzle 60.

Gas flow conduit 50A of FIG. 2 is shown connected to and integral with lid 30. Gas flow conduit 50A generally includes a receiving portion 52A and a nozzle 60. Receiving portion 52A of spray module 20 is a cylindrical bore 53 adapted for receiving a gas source, such as barrel 72 of air gun 71. Receiving portion 52A may be another connector, such as a quick hose connecter, as is known in the art. Barrel 72 and bore 53 include cooperating attachment means. Bore includes a detent 54, such as a spring biased ball, for insertion into a depression, such as into circumferential groove 73 around barrel 72. In this manner, bore 53 (and spray module 20, as illustrated) may freely rotate about barrel 72 and remain upright even if gun 71 is inverted.

Nozzle 60 includes an inlet portion 61 including an inlet end 62 connected to receiving portion 52A for receiving pressurized gas, an exit end 67 for expelling received gas into ambient atmosphere, and a center portion 65 therebetween for conducting gas from inlet end 62 to exit end 67 and adapted so as to create an area of below ambient pressure. In the illustrative embodiment of FIG. 2, inlet end 62 includes a throttle 63 of small cross sectional area. Gas passing through throttle 63 expands in the larger center portion 65 of nozzle 60.

Flake conduit 40 connects enclosure 22 with gas flow conduit 50 and includes a lower or inlet end 42 opening in upper portion 27 of container 23 for receiving gas and suspended flakes 12B therefrom, and an outlet end 48 opening in an area of below-ambient pressure in center portion 65 of nozzle 60 for expelling gas and suspended flake thereinto, and a central portion 43 therebetween. A flow-regulating valve 44 in central portion 43 of flake conduit 40 is operable by a user, such as with lever 47. Flow regulating valve 44 regulates the flow through flake conduit 40. Valve 44, shown in the open position, is a common pipe valve comprising a cylinder having an axis perpendicular to the flake conduit axis and having a bore therethrough having an axis that is alignable through rotation with the flake conduit axis to provide for flow and alignable to be perpendicular to the flake conduit axis to restrict or stop flow. Lever 47 rotates the valve cylinder. Preferably, flake conduit 44 is angled so as to join nozzle 60 at an acute angle with the pressurized gas flow. In this manner, flakes 12 entering nozzle 44 already have a velocity component in the spray direction toward exit end 67. Preferably, also, inlet end 42 is located to as to receive a steady supply of flakes 12. In the illustrative embodiment of circular container 23 and peripheral air holes 36, inlet end 42 is centrally located.

Ambient gas inlet means 35, such as air conduits, such as air holes 36, responsive to gas flow through flake conduit 40, conducts ambient gas into enclosure 22 and directs the ambient gas flow onto flake supply 12A such that at least some dry flake 12 thereof is suspended in upper portion 27 of enclosure 22. In the illustrative embodiment, six air holes are spaced around the periphery of lid 30 so as to direct air down the inner walls of container 23 onto supply 12A of flakes 12 to stir up and suspend flakes 12. The optimal size, number and configuration of air holes are a function of air flow, container size, and flake size. Although holes 36 are shown, small pipes could be included to direct the ambient air flow.

FIG. 3 is a partial cross sectional view of an alternate embodiment of spray module 20. FIG. 3 shows an alternate embodiment of gas flow conduit 50A in which the outlet from the pressurized gas source, such as barrel orifice 74, empties directly into nozzle 60 and is configured such that throttle 63 of FIG. 2 is not needed and is eliminated.

Gun module 70 may be integral with spray module 20 or may be attachable. Gun module 70 is a continuation of gas flow conduit 50 and includes a receiving portion 52B for receiving a gas flow, and barrel orifice 74 for discharging received gas, and a gas passageway, therebetween, not shown. Receiving portion 52B includes means, such as connector 79 connected to pressure hose 95, for receiving a gas flow from a source of gas flow, such as an air pressure tank, not shown, as is known in the art. Gun 71 is of a known type and has a finger grip 75 and a flow valve 76 including a trigger 76T operable by the user for regulating the flow of pressurized gas through gas flow conduit 50B from the pressurized gas source to barrel exit orifice 74.

Receiving portion 52B of said gas flow conduit 50B in gun module 70 includes pressure regulating means, such as valve 77 for regulating the pressure of gas from the pressurized gas source at a given gas flow rate through conduit 50B and a pressure indicator 78 indicating pressure of gas flowing through receiving portion 52B. Valve 77 and indicator 78 are known in the art and readily purchasable.

In one device 10, the diameter of throttle 63 and diameter of gun barrel exit orifice 74 are 0.070". Nozzle center portion 65 and exit portion 67 are 0.250". Flake conduit 40 has a diameter of 0.250" and connects with nozzle 60 at a 36° angle. Flake conduit outlet 48 is located 0.250 from throttle 63, as in FIG. 2, or from barrel orifice 74, as in FIG. 3. Container 23 is 3.5 inches deep and 2.5 inches in diameter. Six air holes 36 are of 0.070" diameter.

Spray device 10 is typically used in the painting of an object as follows. Air will be used as flow gas and ambient gas. The surface of the object is prepared for painting in the usual manner. For example, on bare metal, a primer coat, a sealer coat, and a base coat of color are applied in a typical manner. An under coat, typically a clear coat, but possibly pigmented or translucent, is applied in the traditional manner.

Gun connector 79 is connected to air pressure hose 95 from an air source (not shown). The air in hose 95 is typically about 40 psi. Trigger 76T opens flow valve 76, typically wide open, to produce a desired flow rate and pressure control valve 77 is adjusted to set a desired pressure, as indicated on pressure indicator 78, to produce the desired flow rate. A pressure of 5–10 psi has been found to product good results, with about 7 psi being optimal. Higher pressure results in faster flake speeds. At too high a speed, flakes 12 tend to bounce off the object.

A supply 12A of dry flakes 12 is placed in enclosure 20. Gun 71 is connected to spray module 20. Trigger 76T is operated, thereby opening flow control valve 76 such that gas flows through nozzle 60. Gas flowing through center portion 65 of nozzle 60 creates a low pressure. Then, if flake conduit 40 is open, such as if flow valve 44 is open, ambient air enters air holes 36 to create an air flow 38, shown by arrows, which stirs up supply 12A of flakes 12 and suspends flakes 12B in upper portion 27 of container 23, where they are drawn into flake conduit 40, merge with pressurized gas flow in nozzle 60, and are expelled out nozzle outlet 48 and onto the under coat while the under coat is still wet. Spraying with 0.25" flake is done with nozzle outlet 48 18" to 24" from the surface, with a crisscross pattern.

High speed air is blown immediately on the sprayed flakes 12 to assure that they are flattened onto wet under coat. This is particularly necessary for larger flakes, but, with small flakes, this may not be necessary. High speed air may be blown by completely closing flake flow valve 44, opening pressure valve 77, and blowing air from nozzle 60; or by disconnecting gun 71 from spray module 20, opening pressure valve 77, and blowing air directly from gun barrel 72.

After sprayed flakes 12 are flattened, one or more cover coats, such as of clear resin, may be applied to cover flakes 12. Typically cover coats are colorless or lightly colored transparent coats.

Having described the invention, it can be seen that it provides a very useful device and method for painting with reflective flake, particularly with flakes.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A device for spraying dry flakes comprising:

an enclosure having an interior space including:

a lower portion for holding a supply of dry flakes; and an upper portion;

a gas flow conduit including:

a receiving portion adapted for receiving gas from a pressurized gas source; and a nozzle including:

an inlet end connected to said receiving portion for receiving the pressurized gas from the pressurized gas source;

an exit end for expelling received gas into ambient atmosphere; and a center portion therebetween for conducting gas from said inlet end to said exit end and adapted so as to create an area of below-ambient pressure;

a flake conduit connecting said enclosure and said gas flow conduit including:

an inlet end opening in said upper portion of container for receiving gas and suspended flakes therefrom;

an outlet end opening in said area of below ambient pressure in said center portion of said nozzle for expelling gas and suspended flake thereinto;

a central portion therebetween; and a flake flow regulating valve operable by a user for regulating the flow of gas and suspended flakes through said flake conduit; and ambient gas inlet means, responsive to gas flow through said flake conduit, for conducting ambient gas into said enclosure such that at least some of the dry flake therein is suspended in said upper portion of said enclosure.

2. The device of claim 1 wherein said receiving portion of said gas flow conduit includes:

a flow valve operable by the user for regulating the flow of pressurized gas from the pressurized gas source.

3. The device of claim 2 wherein said receiving portion of said gas flow conduit includes:

pressure regulating means for regulating the pressure of gas from the pressurized gas source at a given gas flow rate.

4. The device of claim 3 wherein said receiving portion of the gas flow conduit includes:

a pressure indicator for indicating pressure of gas flowing through said receiving portion.

5. The device of claim 2 wherein said receiving portion of the gas flow conduit includes:

a pressure indicator for indicating pressure of gas flowing through said receiving portion.

6. The device of claim 1 wherein said receiving portion of the gas flow conduit includes:

a pressure indicator for indicating pressure of gas flowing through said receiving portion.

7. The device of claim 1 wherein said receiving portion of said gas flow conduit includes:

pressure regulating means operable by the user for regulating the pressure of gas from the pressurized gas source to produce a given gas flow rate.

8. The device of claim 1 wherein:

said flake conduit joins said nozzle at an acute angle to the pressurized gas flow.

9. The device of claim 1 wherein:

said enclosure is substantially cylindrical and sufficiently transparent to allow observation of the supply of dry flake; and said ambient gas inlet means includes:

a plurality of holes spaced on the periphery of said enclosure.

10. In combination:

a gas gun including:

connector means for connecting to a pressurized gas source for receiving pressurized gas;

a barrel including:

an orifice for discharging received gas;

a gas passageway therebetween including:

a flow valve operable by a user for regulating the flow of received gas therethrough; and a device for spraying dry flakes comprising:

an enclosure having an interior space including:

a lower portion for holding a supply of dry flakes; and an upper portion;

a gas flow conduit including:

a receiving portion adapted for connection to said barrel of said gas gun for receiving gas therefrom; and a nozzle including:

an inlet end connected to said receiving portion for receiving the pressurized gas from the pressurized gas source;

an exit end for expelling received gas into ambient atmosphere; and a center portion therebetween for conducting gas from said inlet end to said exit end and adapted so as to create an area of below ambient pressure;

a flake conduit connecting said enclosure and said gas flow conduit including:

an inlet end opening in said upper portion of container for receiving gas and suspended flakes therefrom;

an outlet end opening in said area of below ambient pressure in said center portion of said nozzle for expelling gas and suspended flake thereinto; and a central portion therebetween; said flake conduit including a flake flow regulating valve operable by the user for regulating the flow through said flake conduit; and gas inlet means, responsive to gas flow through said flake conduit, for conducting ambient gas into said enclosure such that at least some of the dry flake therein is suspended in said upper portion of said enclosure.

11. The combination of claim 10 wherein said gas gun includes:

pressure regulating means for regulating the pressure of gas flowing through said gun at a given gas flow rate; and a pressure indicator for indicating pressure of gas flowing through said gun.

12. The combination of claim 10 wherein said barrel and said receiving portion include cooperative attachment means such that said barrel freely rotates in said receiving portion.

13. A method of spraying flakes comprising the steps of:

procuring a device including an enclosure having an interior space including: a lower portion for holding a supply of dry flakes; and an upper portion; a gas flow conduit including: a receiving portion adapted for connection to a pressurized gas source for receiving gas therefrom; and a nozzle including: an inlet end connected to the receiving portion for receiving the pressurized gas from the pressurized gas source; an exit end for expelling received gas into ambient atmosphere; and a center portion therebetween for conducting gas from the inlet end to the exit end and adapted so as to create an area of below-ambient pressure; a flake conduit connecting the enclosure and the gas flow conduit including: an inlet end opening in the upper portion of container for receiving gas and suspended flakes therefrom; an outlet end opening in the area of below-ambient pressure in the center portion of the nozzle for expelling gas and suspended flakes thereinto; a central portion therebetween; and a flake flow regulating valve operable by a user for regulating the flow through the flake conduit; and ambient gas inlet means, responsive to gas flow through the flake conduit, for conducting ambient gas into the enclosure such that at least some of the dry flake therein are suspended in the upper portion of the enclosure;

placing a supply of dry flakes in the enclosure; and connecting a source of pressurized gas to the receiving portion such that gas from the pressurized gas source flows through the gas flow conduit.

14. The method of claims 13 wherein the receiving portion of the procured device includes a flow valve operable by the user for regulating the flow of pressurized gas from the pressurized gas source; and said method further includes:

operating the flow valve such that gas from the pressurized gas source flows through the gas flow conduit.

15. The method of claim 13 wherein the receiving portion of the procured device includes a flow valve operable by the user for regulating the flow of gas through the gas conduit.

16. A method of painting an object comprising the steps of:

applying an under coat of paint to the object;

procuring a device including an enclosure having an interior space including: a lower portion for holding a supply of dry flakes; and an upper portion; a gas flow conduit including: a receiving portion adapted for connection to a pressurized gas source; and a nozzle including: an inlet end connected to the receiving portion for receiving the pressurized gas from the pressurized gas source; an exit end for expelling received gas into ambient atmosphere; and a center portion therebetween for conducting gas from the inlet end to the exit end and adapted so as to create an area of below ambient pressure; a flake conduit connecting the enclosure and the gas flow conduit including: an inlet end opening in the upper portion of container for receiving gas and suspended flakes therefrom; an outlet end opening in the area of below ambient pressure in the center portion of the nozzle for expelling gas and suspended flake thereinto; and a central portion therebetween; and ambient gas inlet means, responsive to gas flow through the flake conduit, for conducting ambient gas into the enclosure such that at least some of the dry flakes therein are suspended in the upper portion of the enclosure;

placing a supply of dry flakes in the enclosure;

connecting the receiving portion of the procured device to a pressurized gas source such that gas from the pressurized gas source flows through the gas flow conduit;

spraying dry flakes onto the under coat while the under coat is still wet; and applying a cover coat of paint over the sprayed flakes.

17. The method of claim 16 further comprising the steps of:

ensuring that the procured device includes a flake flow regulating valve operable by a user for regulating the flow of gas and suspended flakes through the flake conduit; and closing the flake flow regulating valve and then blowing gas from the nozzle on the sprayed flakes to flatten the sprayed flakes on the undercoat.

18. A method of painting an object comprising the steps of:

applying an under coat of paint to the object;

blowing dry flakes onto the under coat while the under coat is still wet such that the blown flakes adhere to the undercoat; the blowing being done with a device having a gas flow, a nozzle, and a source of dry flakes and adapted for introducing the dry flakes into the gas flow and for blowing the dry flakes suspended in a stream of the gas out of the nozzle onto the under coat;

closing a flake flow regulating valve on the device such that no dry flakes enter the gas flow out of the nozzle; and then with the device, blowing gas containing no flakes out of the nozzle on the blown flakes adhering to the under coat such that the blown flakes on the undercoat are flattened; and applying a cover coat of paint over the blown flakes adhering to the under coat.

19. A device for spraying dry flakes comprising:

an enclosure having an interior space including:

a lower portion for holding a supply of dry flakes; and an upper portion; said enclosure being substantially cylindrical and sufficiently transparent to allow observation of the supply of dry flake; and a gas flow conduit including:

a receiving portion adapted for receiving gas from a pressurized gas source; and a nozzle including:

an inlet end connected to said receiving portion for receiving the pressurized gas from the pressurized gas source;

an exit end for expelling received gas into ambient atmosphere; and a center portion therebetween for conducting gas from said inlet end to said exit end and adapted so as to create an area of below-ambient pressure;

a flake conduit connecting said enclosure and said gas flow conduit including:

an inlet end opening in said upper portion of container for receiving gas and suspended flakes therefrom;

an outlet end opening in said area of below ambient pressure in said center portion of said nozzle for expelling gas and suspended flake thereinto; and a central portion therebetween; and ambient gas inlet means including a plurality of holes spaced on the periphery of said enclosure, responsive to gas flow through said flake conduit, for conducting ambient gas into said enclosure such that at least some of the dry flake therein is suspended in said upper portion of said enclosure.

20. The device of claim 19 wherein said flake conduit includes:

a flow regulating valve operable by a user for regulating the flow of gas and suspended flakes through said flake conduit.

21. The device of claim 19 wherein said receiving portion of said gas flow conduit includes:

a flow valve operable by the user for regulating the flow of pressurized gas from the pressurized gas source.

22. The device of claim 21 wherein said receiving portion of said gas flow conduit includes:

pressure regulating means for regulating the pressure of gas from the pressurized gas source at a given gas flow rate.

23. The device of claim 22 wherein said receiving portion of the gas flow conduit includes:

a pressure indicator for indicating pressure of gas flowing through said receiving portion.

24. The device of claim 21 wherein said receiving portion of the gas flow conduit includes:

a pressure indicator for indicating pressure of gas flowing through said receiving portion.

25. The device of claim 19 wherein said receiving portion of the gas flow conduit includes:

a pressure indicator for indicating pressure of gas flowing through said receiving portion.

26. The device of claim 19 wherein said receiving portion of said gas flow conduit includes:

pressure regulating means operable by the user for regulating the pressure of gas from the pressurized gas source to produce a given gas flow rate.

27. The device of claim 19 wherein:

said flake conduit joins said nozzle at an acute angle to the pressurized gas flow.

28. The method of claim 18 wherein:

the dry flakes substantially have a maximum dimension of 0.004 inches or greater.

29. The method of claim 18 wherein:

the dry flakes substantially have a maximum dimension of 0.008 inches or greater.

30. The method of claim 18 wherein:

the dry flakes substantially have a maximum dimension of 0.035 inches or.

31. A method of painting an object comprising the steps of:

applying an under coat of paint to the object;

blowing dry flakes onto the under coat while the under coat is still wet such that the blown flakes adhere to the undercoat; the blowing being done with a device having a gas flow, a nozzle, and a source of dry flakes and adapted for introducing the dry flakes into the gas flow and for blowing the dry flakes suspended in a stream of the gas out of the nozzle onto the under coat;

blowing gas not containing dry flakes on the blown flakes adhering to the under coat such that the blown flakes on the undercoat are flattened; and applying a cover coat of paint over the blown flakes adhering to the under coat.

* * * * *